United States Patent [19]

Sirois et al.

[11] Patent Number: 4,700,168

[45] Date of Patent: Oct. 13, 1987

[54] INTEGRATED TEMPERATURE CONTROL UNIT

[75] Inventors: Normand W. Sirois, Limerick; John A. Arthur, Auburn, both of Me.

[73] Assignee: Classic Corporation, Jessup, Md.

[21] Appl. No.: 846,156

[22] Filed: Mar. 31, 1986

[51] Int. Cl.[4] ..... H01H 37/76; H01H 37/12

[52] U.S. Cl. ..... 337/327; 337/330

[58] Field of Search ..... 337/327, 329, 330, 320, 337/321, 312, 317, 319

[56] References Cited

U.S. PATENT DOCUMENTS

| | | | |
|---|---|---|---|
| 2,032,041 | 2/1936 | Beck . | |
| 2,833,894 | 5/1958 | Weber et al. . | |
| 2,929,901 | 3/1960 | Bloch . | |
| 3,564,183 | 2/1971 | Eshelman | 337/319 |
| 3,568,123 | 3/1971 | Wolfe et al. | 337/323 |
| 3,617,972 | 11/1971 | Branson et al. | 337/323 |
| 3,636,287 | 1/1972 | Jorgenson et al. | 337/320 |

*Primary Examiner*—Harold Broome

*Attorney, Agent, or Firm*—Finnegan, Henderson, Farabow, Garrett & Dunner

[57] ABSTRACT

A temperature control device of the bulb and capillary tube type having a molded plastic housing that has integrally formed support members for positioning and securing individual switch blades and temperature sensing components. The individual switch components being fixed in operative position relative to the integral support members by molded projections in the housing and mated cutout sections in the blades, and a plastic shim.

13 Claims, 5 Drawing Figures

INTEGRATED TEMPERATURE CONTROL UNIT

BACKGROUND OF THE INVENTION

1. Field of the Invention

The present invention relates to a temperature control device; and more particularly, to a temperature control device of the bulb and capillary type.

2. Description of the Related Art

A bulb and capillary type temperature sensing and control device, of the type used to regulate the temperature of a waterbed, for example, typically comprises a sensing bulb, a capillary tube, a diaphragm assembly, and a switch structure. The diaphragm assembly and switch are routinely assembled within a metal frame that has an adjustment shaft and other components to produce the desired temperature control, and the frame is subsequently assembled as one particular component of the control unit. The completed temperature control unit includes an enclosure or housing that supports a temperature sensing control knob and other control related components, such as indicator lights, and receptacles for the power cord and heater connections.

Heretofore, the metal frame separately enclosing the control related components and adjustment shaft was independently secured to the housing in the appropriate position. Such thermostat manufacture required special equipment and separate steps for precisely positioning the movable and adjustable parts, such as the calibration screw, during assembly.

SUMMARY OF THE INVENTION

It is an object of the present invention to provide a temperature control device that is relatively simple in its construction and inexpensive to manufacture and assemble.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

To achieve the foregoing objects, and in accordance with the purposes of the invention as embodied and broadly described herein, a temperature control device is provided having a non-metallic dieletric housing that comprises a panel having a front surface and a rear surface, with an aperture means therethrough for rotatably supporting a shaft on which is mounted a control knob adjacent the front surface, and a cam adjacent the rear surface.

Support means integral with the housing panel extend rearwardly from the rear surface and are adapted to support a temperature responsive means for providing movement relative to the housing in accordance with a sensed temperature, and a switch which is actuable to an open and closed position in accordance with the movement of the temperature responsive means and the control knob setting.

In accordance with one preferred embodiment of the invention, there is provided a temperature control device that comprises a housing having a panel with a front and rear surface and apperture means therethrough. The rear surface has integrally formed first and second support means, each including a pair of spaced parallel surfaces extending substantially perpendicular to the rear surface. A shaft is rotatably mounted in the apperture means; a control knob is fixed to the shaft adjacent the front surface and a cam is fixed to the shaft adjacent the rear surface. A hinge blade and a lower contact switch blade are positioned in physical engagement with respective spaced surfaces of the first support means, the hinge blade is positioned to bias against the cam, and a mounting blade is supported between the spaced surfaces of the second support means. A temperature responsive means is mounted on the mounting blade in position to transfer movement to the hinge blade; and a dielectric shim is inserted between the lower contact blade and the hinge blade to secure the blades in operative position. The shim is also configured with a flange to hold the lower contact blade, the hinge blade, and the mounting blade in the first and second support means, respectively.

BRIEF DESCRIPTION OF THE DRAWINGS

The accompanying drawings, which are incorporated in an constitute a part of the specification, illustrate a preferred embodiment of the invention and, together with a general description given above and the detailed description of the preferred embodiment given below serve to explain the principles of the invention.

DESCRIPTION OF THE PREFERRED EMBODIMENT

Reference will now be made in detail to the present preferred embodiment of the invention as illustrated in the accompanying drawings.

Figure 1:
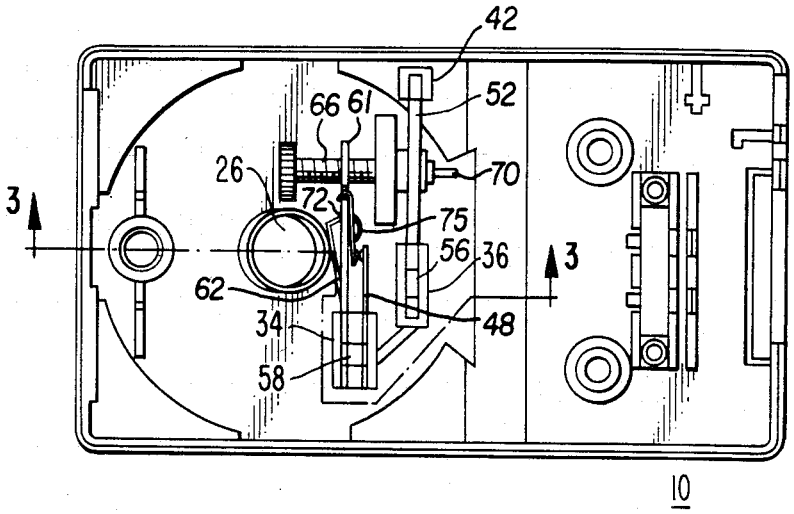
FIG. 1 is a rear view of a housing assembly in accordance with one embodiment of the present invention.
Figure 3:
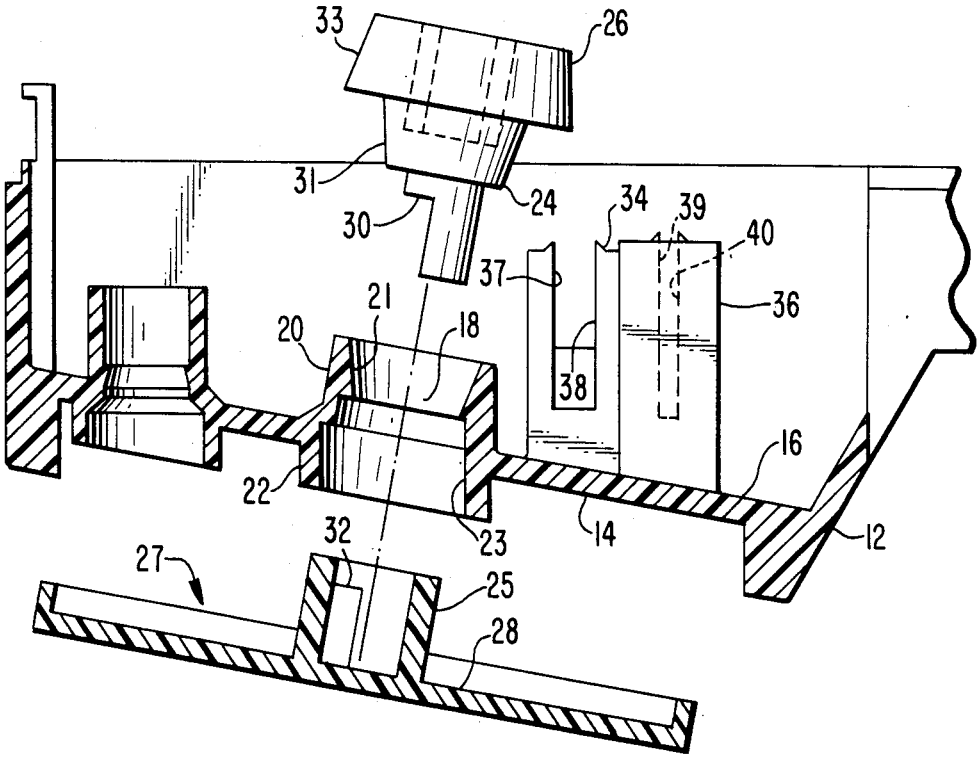
FIG. 3 is an enlarged sectional view of the housing taken on line 3—3 of FIG. 1 illustrating an exploded view of the control knob and cam assembly.

In accordance with the present invention and as shown in FIGS. 1 and 3 there is provided a housing assembly 10 for a temperature control device which is preferably molded plastic, being a good dielectric and inexpensive to manufacture in large quantities. The housing assembly comprises a panel, 12, having a front surface, 14, and a rear surface, 16 with aperture means 18 therethrough. The aperture means has rearwardly extending peripheral walls, 20 and forwardly extending peripheral walls, 22. The rearwardly extending walls, 20, define at inner surface 21 a frusto-conical bore and the forwardly extending walls 22 of the aperture means define at inner surface 23 a cylindrical bore into which cylindrical projection 25 of control knob 28 rotatably fits.

A cam 26, has an integral shaft 24, with a keyed portion 30 and a frusto-conical portion 31. With the control knob 28 rotatably mounted in the cylindrical portion 23 of the bore 18, the cam 26 is snuggly and precisely fit so that its portion 24 is rotatable in the frusto conical portion 21; and the keyed portion 30 of the shaft 24 engages a slot 32 in a bore of projection 25. Thus, the cam 26 rotates with the knob 28 with little play to provide precise location without misalignment of the cam driving surface 33.

Figure 2:
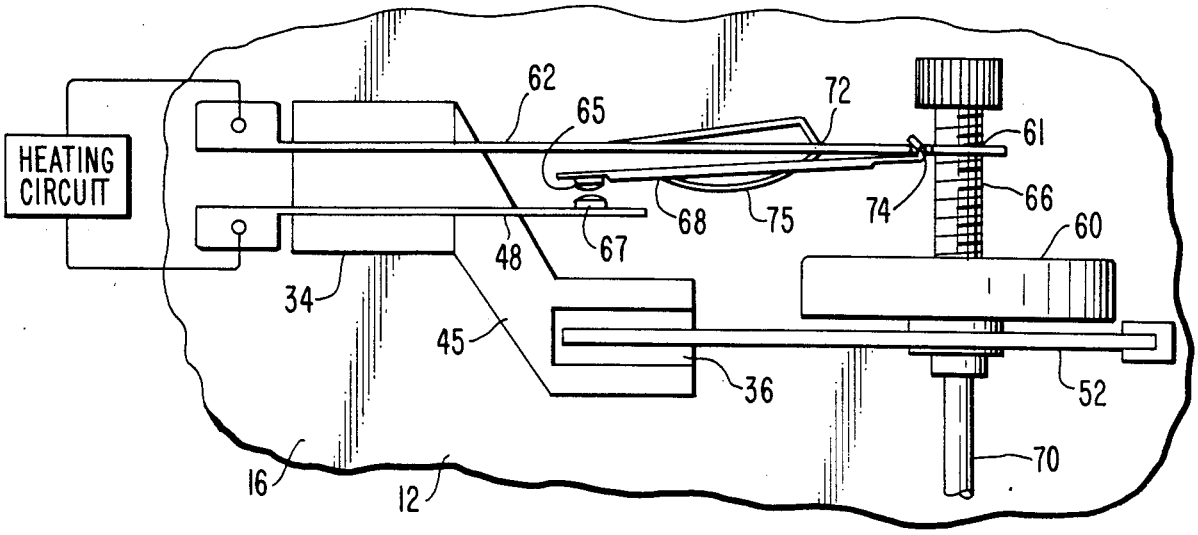
FIG. 2 is an enlarged fragmentary sectional view of the housing assembly of FIG. 1 illustrating the switching mechanism and temperature responsive items assembled therein.

In accordance with the invention, the housing assembly 10, has a first integral support means 34 and a second integral support means 36 integrally molded with the rear surface 16 of the front panel 12. The first integral support means 34 includes parallel spaced opposed planar surfaces 37 and 38. As shown in FIG. 2, and with continued reference to FIGS. 1 and 3, the opposed spaced planar surfaces 37 and 38 of the first integral support contact and position hinge blade 62, and lower contact blade 48.

As further shown in FIG. 1 and FIG. 2 a second integral support means 36 is configured with a slot having parallel planar opposed surfaces 39 and 40 configured to contact and support in operative position a mounting blade 52 for supporting a diaphram 60 in position to transfer movement to a calibration screw 66 adjustably threadable in opening 61 of the hinge blade 62. The mounting blade 52 is configured with a slotted cutout section open at one end of the mounting blade for accepting and mounting the diaphragm 52 and connected capillary 70 tube therein. In the present embodiment, movement of the diaphram relative to the housing is in accordance with the sensed temperature conducted by a liquid in capillary tube 70 as the liquid expands or contracts in response to the sensed temperature. The positive or negative displacement of the diaphragm with respect to the housing is transferred to the hinge blade 62 to actuate to an open or closed position the contact studs 65 and 67 affixed to the upper contact blade 68 and lower contact blade 48.

As shown in FIG. 1 and with continued reference to FIG. 2 the second integral support 36 includes a coplanar spaced portion 42 which extends rearwardly from the rear surface 16 of the panel 12 of the housing assembly 10 in a position to support the mounting blade 52 at its opposite end. The integral support portion 42 of the second means 36 is configured with a slot with parallel opposed surfaces coplanar with respective opposed surfaces of integral support means 36.

Figure 5:
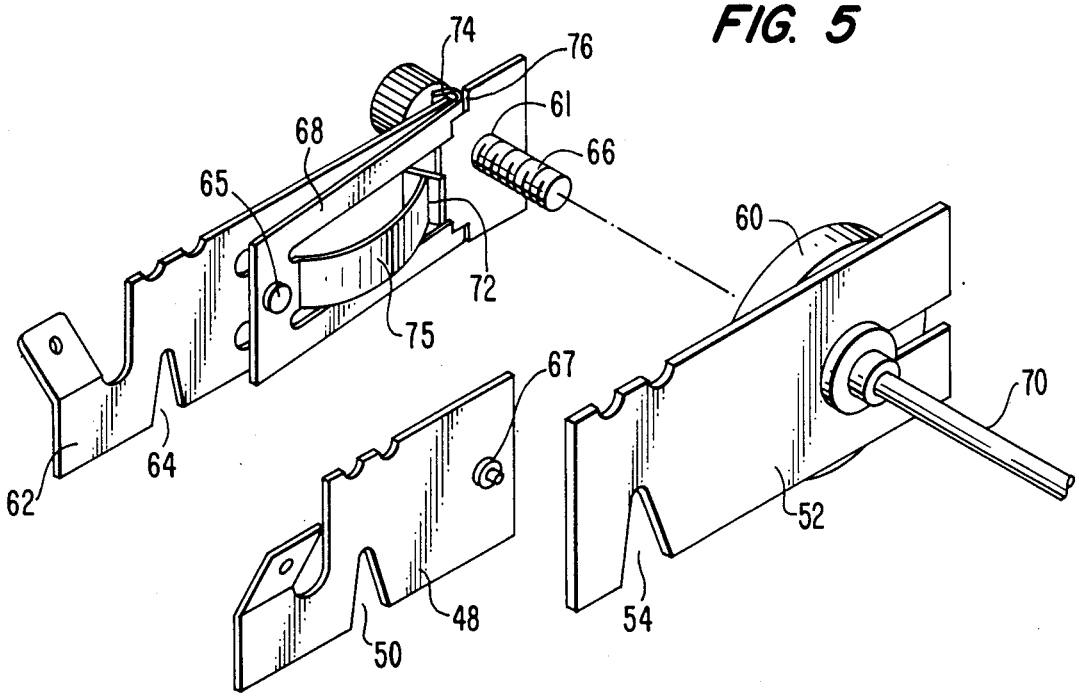
FIG. 5 is an exploded isometric view of the switch blades and mounting blades illustrated in FIG. 2 to illustrate the switch blades and mounting blade in more detail.
Figure 4:
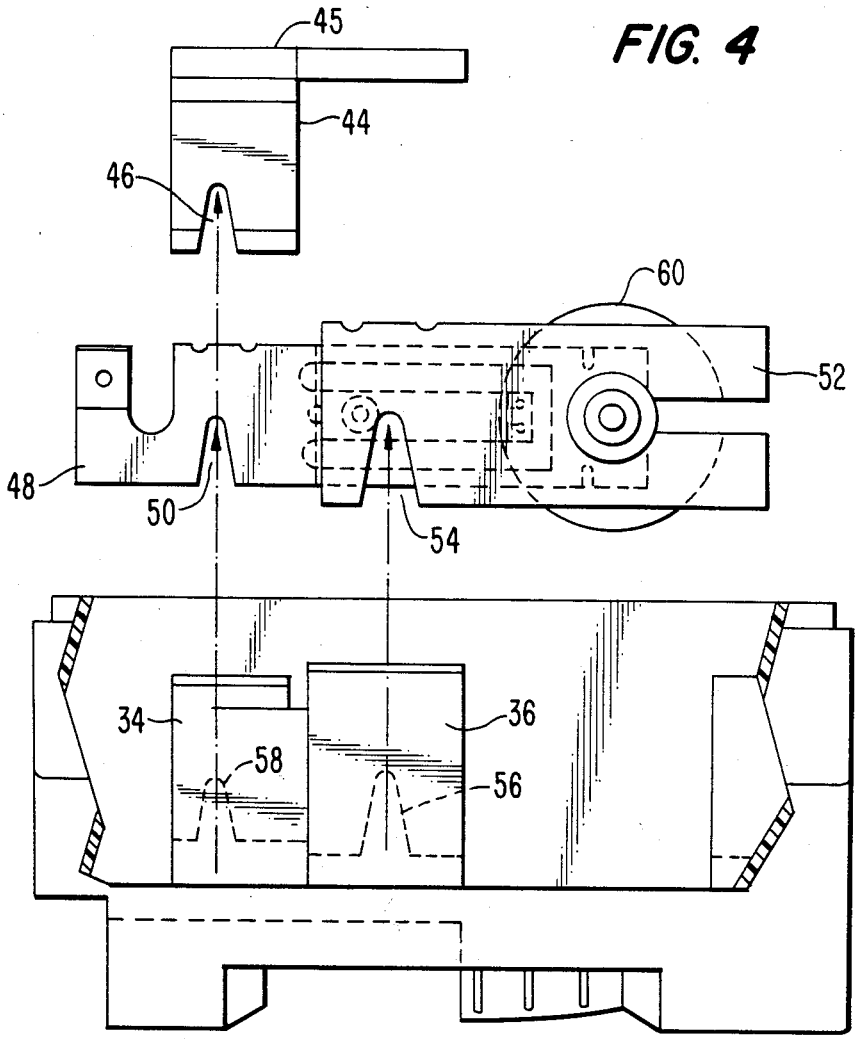
FIG. 4 is an enlarged side view of the housing of FIG. 1, partly broken away, and illustrating an exploded view of the swtich blades, shim and temperature responsive element to show the manner of assembly.

As shown in FIG. 5, the hinge blade 62 and the lower contact blade 48 are configured with slotted cutout sections 64 and 50 respectively. Similarly, mounting blade 52 is configured with a slotted cutout section 54. As depicted in FIG. 4 and with continued reference to FIG. 5, the first integral support 34 has a projection 58 which is preferably wedge shaped and molded to the rear surface 16 of the front panel 12 between the opposed spaced surfaces 37 and 38 of the first integral support. The second integral support 36 has a similarly configured integral wedge shaped projection 56, positioned between the opposed parallel surfaces 39 and 40, molded to the rear surface 16 of the front panel 12. The previously recited slotted cutout sections 64 and 50 are configured to mate with molded projection 58 of the first integral support 34 to provide ease of assembly and restrict lateral movement of hinge blade 62 and lower contact blade 48 when inserted between the opposed parallel surfaces 37 and 38 of the integral support 34. The support blade 52 is configured to tightly fit at one end in the slot of support 36 between opposed planar surfaces 39 and 40, and at its opposite end in the slot formed by the opposed parallel surfaces of the integral support 42. The cutout section 54 and its complementary molded mating portion 56 serve to provide for ease of assembly and restrict lateral movement of the mounting blade 52 when inserted between the opposed parallel surfaces 39 and 40 of integral support 36.

As depicted in FIG. 4, the shim 44, which fits between the blades 62 and 48, to tightly secure the blades against the opposed parallel surfaces of integral support 34, has a cutout section 46 for mating with the molded wedge 58 when inserted between the switch blades 62 and 48, so that the shim 44 can extend to the base of the projection 58. The shim 44 also has a top flange protion 45 which covers the top edge of the blades 48 and 62 positioned between the first integral support 34 and the edge of support blade 52 positioned between the second integral support 36. The flange portion 45 of the shim 44 serves to provide support in the direction extending rearwardly from the rear surface 16 of the front panel 12. The flange portion 45 of the shim 44 may be fixed to the supports 34 and 36, preferably by gluing or ultrasonic welding.

With continued reference to FIG. 4 and FIG. 5, the relative ease of assembly of the control components of the present invention, and the elimination of potential misalignment of the components provided by the positive positioning necessary in fitting the blades 48, 62 and 52 on the projections 58 and 56 respectively, is readily apparent. The assembly procedure may proceed in the following manner. Switch blades 48 and 62 are inserted between the parallel opposed surfaces 37 and 38 of integral support 34 such that the cutout sections 50 and 64 fit over the projection 58. The wedge shape of projection 58 provides easy assembly as the broader end of cutouts 50 and 64 need only initially cover the tip of projection 58 as the blades are inserted. The shim 44, is next inserted between the blades 48 and 62 and the cutout section 46 is fitted over the projection 58 with the same relative ease and accuracy. Next, mounting blade 52 is inserted between the parallel opposed surfaces 39 and 40 of integral support 36 such that the cutout section 54 fits over the projection 56 and the same ease of assembly and accuracy of alignment is realized due to the wedge shape of projection 56 and cutout section 54.

Referring to FIGS. 2 and 5, and in accordance with a preferred embodiment, an electrical switch is comprised of an upper contact blade 68, a hinge blade 62, and a lower contact blade 48. The upper contact blade 68 includes a contact stud 65 positioned directly above a reciprocal contact stud 67 in lower contact blade 48. The upper contact blade 68 is configured with bent tabs 74 which are inserted into slots 76 of the hinge blade 62. The upper contact blade 68 further includes a bow spring 75 with a tab at the free end, coupled with upper contact blade 62 at 72. The upper contact blade 74 is coupled with the hinge blade 62 at tab 74, to provide location and securement of the blades 62 and 68 to one another. This method of assembly eliminates the need for welding, brazing, riveting, or other methods requiring more complicated means for joining the blades and thus provides a less expensive and less complicated means of joining the blades which results in substantial savings in the expense associated with assembly of the temperature control housing.

As shown in FIG. 2, a diaphragm 60 provides displacement with respect to the housing assembly in accordance with the thermal expansion of the fluid in capilary tube 70. The displacement of the diaphragm 60 is transferred to the hinge blade 62 by means of a threaded calibration screw 66 located in the apperture 61 at the end of the hinge blade. Coordinated movement of the hinge blade 62 and the upper contact blade 68 serves to move the contact studs 65 and 67 to an open position upon achieving the selected temperature of the control volume. As the surface of the diaphram 60 contracts, the corresponding displacement of the calibrated screw 66 in conjunction with the bow spring 75 operates to close the contact studs 65 and 67 and complete an electric circuit providing current to a heating element.

As shown in FIG. 4, the contact studs 65 of the upper contact blade 68 and the contact stud 67 of the lower contact blade 48 are riveted in place. The relative positioning of the contact studs 65 and 67 on upper contact blade 68 and lower contact blade 48 provides a means for adjusting the thermostat differential. The thermostat differential is controlled by the length of the contact stud biasing against the hinge blade 62. Increasing the stud length decreases differential, decreasing stud length increases differential. Adjustment of the stud is accomplished during the contact to blade riveting assembly operation, consequently no independent operation is required to adjust differential and significant labor savings are realized.

The cam surface 26, molded to the shaft 24 is positioned on the rear surface 16 of the front panel 12 relative to the support means 34 so that the cam surface 26 adjustably biases against the hinge blade 62. The frusto-conical bore of apperture 18 and the complementary frust-conical configuration of the shaft 24 serves to provide positive centering of the cam with respect to the housing opening thus eliminating potential misalignment of parts and assembly problems due to normal tolerances experienced from injection molding of plastic parts. Since any misalignment or poor fit at the mating surfaces could result in improper operation of the temperature adjustment mechanism a secondary operation would be required to ensure that the cam surface 26 mates properly with upper hinge blade 62. Thus, the frusto-conical bore shaped configuration of the aperture 18 and the shaft 24 serves to eliminate any additional steps necessary to ensure proper alignment of the parts and results in significant labor and material savings in the assembly of the housing and switch mechanism.

Additional advantages and modifications will readily occur to those skilled in the art. The invention in its broadest aspects is, therefore, not limited to the specific details representative apparatus and illustrative example shown and described. Accordingly, departures may be made from such details without departing from the spirit or scope of applicants general inventive concept.

What is claimed is:

1. A temperature control device comprising a housing assembly, a temperature responsive means and a switch, said housing assembly comprising a panel having a front and a rear surface, with aperture means therethrough, a shaft rotatably mounted in said aperture means, a temperature control knob fixed to one end of said shaft adjacent said front surface, a cam fixed to the other end of said shaft adjacent said rear surface, and support means, integral with said panel and extending rearwardly from said rear surface, said support means supporting said temperature responsive means, said temperature responsive means providing movement relative to said housing in accordance with a sensed temperature, and said support means supporting said switch, said switch being actuable to an open and closed position in accordance with said movement of said temperature responsive means and said control knob setting.

2. A temperature control device according to claim 1 wherein said support means comprises:

a first integral support having a pair of opposing spaced parallel surfaces extending substantially perpendicular to said rear surface adapted to hold one blade of said switch in position biasing against said cam, and adapted to position another blade of said switch spaced from said first blade;

a second integral support adapted to support said temperature responsive means in a position to transfer movement to said blade biasing against said cam; and a shim means insertable between said switch blades and adapted to engage said blades against said parallel surfaces for securing said switch to the housing.

3. A temperature control device according to claim 1 wherein said aperture means comprises integral walls extending from said front and rear surfaces of said panel, said front extending wall defining a cylindrical bore and said rear extending wall defining a frusto-conical bore in communication with said cylindrical bore; and wherein said shaft has a frusto-conical portion for fitting rotatably in said frusto-conical bore.

4. A temperature control device according to claim 2 wherein said first integral support further comprises a wedge-shaped projection bridging the spaced surfaces and adapted to engage a similarly configured slot in each of said switch blades for positioning said blades in a lateral direction relative to said surfaces.

5. A temperature control device according to claim 3 wherein said shaft and said temperature control knob have complementary slot and keyed portions to lock said knob and said cam against rotation relative to one another.

6. A temperature control device as in claim 2, wherein said shim means includes an integral flange portion in engagement with said first integral support and said second integral support when said shim means is fully inserted between said supported switch blades.

7. A temperature control device, comprising a housing having a panel with a front and rear surface and aperture means therethrough, said rear surface having integrally formed first and second support means, each said support means including a pair of spaced parallel surfaces extending substantially perpendicular from said rear surface, a shaft rotatably mounted in said aperture means;

a control knob fixed to said shaft adjacent said front surface;

a cam fixed to said shaft adjacent said rear surface;

a hinge blade and a lower contact switch blade positioned in physical engagement with respective spaced surfaces of said first support means, said hinge blade being positioned to bias against said cam;

a mounting blade supported between said spaced surfaces of said second support means;

a temperature responsive means fixed to said mounting blade in position to transfer movement to said hinge blade; and a dielectric shim positioned between said hinge blade and said lower contact blade to fix said blades in operative position in said first support means, said shim having a portion extending over said support means to hold said hinge blade, said lower contact blade and said support blade in said first and second support means respectively.

8. A temperature control device according to claim 7 wherein said first support means further comprises an integrally formed projection extending rearwardly from said rear surface and bridging said spaced parallel surfaces; and wherein said upper and lower contact blades each have a similarly configured slot positioned to receive said projection when said blades are in operative position.

9. A temperature control device according to claim 7 wherein said holding portion of said shim is an integral flange in physical engagement with said first and second support means.

10. A temperature control device according to claim 7 wherein said aperture means includes a frusto-conical bore adjacent said rear surface and a cylindrical bore adjacent said front surface; and wherein said shaft has a frusto-concial portion and a co-axial circular portion, said frusto-conical portion being configured to snuggly and rotatably fit in said similarly shaped bore, and wherein said control knob has a cylindrical projection engaging said circular portion of said shaft.

11. A temperature control device according to claim 7 wherein each of said spaced parallel surfaces of said second support means have coplanar spaced portions; and wherein said temperature responsive means is mounted between said coplanar portions.

12. A temperature control device according to claim 7 wherein said hinge blade has an aperture in registry with said temperature responsive means, and a screw threaded in said aperture for adjustably engaging said temperature responsive means.

13. A temperature control device according to claim 7 wherein said upper contact blade includes a bow spring integral with said upper contact blade and hinged at one end to said hinge blade.

* * * * *